US006431108B1

(12) United States Patent
Lopez-Perea Lloveres et al.

(10) Patent No.: US 6,431,108 B1
(45) Date of Patent: Aug. 13, 2002

(54) SYSTEM FOR KEEPING AFLOAT ANY TYPE OF BOAT IN CASE OF A LEAK

(76) Inventors: Vicente Lopez-Perea Lloveres, San Bartolomé, 12 Pravio-Cambre, A Coruña (ES), E-15668; César Gomez Portela, Escalera B, 2° Izda, María Luisa Durán Marquina, 20, A Coruña (ES), E-15011

( * ) Notice: Subject to any disclaimer, the term of this patent is extended or adjusted under 35 U.S.C. 154(b) by 0 days.

(21) Appl. No.: 09/831,265

(22) PCT Filed: Nov. 12, 1999

(86) PCT No.: PCT/ES99/00365

§ 371 (c)(1),
(2), (4) Date: Jul. 18, 2001

(87) PCT Pub. No.: WO00/29284

PCT Pub. Date: May 25, 2000

(30) Foreign Application Priority Data

Nov. 16, 1998 (ES) ..... 9802401

(51) Int. Cl.[7] ..... B63B 43/02
(52) U.S. Cl. ..... 114/360; 114/68
(58) Field of Search ..... 114/68, 360, 123

(56) References Cited

U.S. PATENT DOCUMENTS

| | | | | |
|---|---|---|---|---|
| 1,328,122 A | | 1/1920 | Buell | |
| 2,938,488 A | | 5/1960 | Hathaway | 114/54 |
| 3,016,858 A | | 1/1962 | Johnson | 114/39 |
| 3,340,842 A | * | 9/1967 | Winslow | 114/360 |
| 3,440,989 A | | 4/1969 | Ettinger | 114/68 |
| 3,940,989 A | | 3/1976 | Engerstam | 73/379 |
| 4,817,555 A | * | 4/1989 | Meinen | 114/360 |
| 4,864,961 A | * | 9/1989 | Slonski | 114/360 |
| 4,887,541 A | | 12/1989 | Rodemann | 114/68 |

FOREIGN PATENT DOCUMENTS

| | | |
|---|---|---|
| FR | 2 741 588 | 5/1997 |
| GB | 2 120 177 A | 11/1983 |

* cited by examiner

*Primary Examiner*—Ed Swinehart
(74) *Attorney, Agent, or Firm*—Sheridan Ross P.C.

(57) ABSTRACT

A system to keep any type of vessel afloat in case of entry of water, by means of providing inflatable flotation elements through the outside of the hull of the vessel, including a variety of mechanisms that are activated automatically when a water level detecting device inside the vessel detects that water has reached a maximum permitted level, which causes the opening of an electrically operated valve to allow pressurised fluid to pass in order to unfold said flotation elements. Alternatively, another unfolding mechanism may consist of a pair of cylinders screwed themselves, through the wall of the hull, of which the interior cylinder encloses the flotation elements and the exterior includes a cover on its outside face that can be ejected by the pressure exerted from the interior. FIG. 1.

8 Claims, 2 Drawing Sheets

SYSTEM FOR KEEPING AFLOAT ANY TYPE OF BOAT IN CASE OF A LEAK

PURPOSE OF THE INVENTION

This invention refers to a system to keep any type of vessel afloat when an emergency situation arises caused by the appearance of the entry of water, a collision, filtration, grounding, or any other situation, which provides essential new characteristics and notable advantages with respect to the systems that are known and used in the current state of the art.

More specifically, the invention proposes the development of a system that provides sufficient flotation elements that are adequately effective in preventing the sinking of a vessel when an emergency like those specified earlier occurs. Activation is automatic, once the entry of water into the vessel has been detected and once the water has reached a predetermined level, said system providing flotation elements which are inflated automatically with the appropriate fluid and are in charge of keeping the vessel afloat for the time needed for different rescue and/or repair operations.

The field of application of the invention is in the naval industry dedicated to the manufacture and/or maintenance of ships, recreational and/or fishing boats and similar, as well as the rescue equipment for them.

BACKGROUND AND SUMMARY OF THE INVENTION

It is a known fact that at certain times and with some frequency, very dangerous situations arise on the high seas, caused by breakage, malfunctions, leaks, accidents, etc. in which vessels are sometimes involved. These types of situations are normally very difficult to resolve, keeping in mind the difficulties to access the places in which they occur, regardless of whether this is done by sea or by air, and especially when it involves a large number of people; for this reason, many of these problems often end in catastrophe, at least for part of the people involved.

Although many vessels have some means among their customary auxiliary equipment aimed at being used in rescue operations if necessary, such as lifeboats or even individual flotation elements. Although these methods have been effective in some situations, the truth is that they have always been shown to be insufficient, and in many cases, useless, if they cannot be used due to the speed with which the catastrophe develops.

Anti-shipwreck systems are known, of the type that incorporate one or several floats coupled outside the vessel, which increases the beam and which can be inflated with pressurised air when a situation of extreme. danger arises in the case of a leak (Spanish utility model U9403303).

These floats or inflatable elements are found in grooves superimposed along the hull of the vessel (European patent EP-A-0487527); in other cases, these elements are housed even in the inside in a net wrapping (Spanish patent P9302462). U.S. Pat. No. 3,440,989 describes a fully organized, self-contained flotation unit adapted to be amounted inside a compartment of a boat, conveniently attached to the ceiling of the craft's compartment, and deploying the flotation elements inside the craft's compartment.

However, there are certain problems associated with the aforementioned devices and systems, such as the appearance of possible fissures, cracks, or fractures in the protection means of the inflatable elements, due to permanent direct contact with the seawater, due to contact with docks, or due to climatic factors, which may endanger the proper functioning of the anti-shipwreck system.

Another known problem associated with these systems is that their installation requires that the hull of the vessel be perforated.

Other security systems use high-pressure gas to fill the inflatable elements, with the high risk of explosion or fire that this involves.

Therefore, there is real need in practice for effective auxiliary and/or complementary systems to solve the problems of the aforementioned types, in particular when these problems represent an effective risk of the loss of human life and/or economic losses.

The main object of this invention is the provision of a flotation system that is quickly activated, able to anticipate any danger situation, and prevent a real risk for people, as well as being automatic, without the need for any intervention of the personnel on the vessel, once there is a particular elevation in the water level inside the vessel, and which will provide the means that will be capable of keeping the vessel afloat for the time needed for rescue and/or repair and/or towing of the vessel to a safe place, therefore solving the problems that exist in the known systems to obtain flotation of vessels without the requirement of auxiliary systems.

In accordance with the invention, these objectives are fully achieved with the planned system, which develops a system that can deploy a variety of flotation elements, in variable numbers depending on the type of vessel, on the outside of the hull and along a line that is at the approximate height of the flotation line. To do this, the flotation system of the invention foresees the use of detection devices inside the vessel to detect the height progressively reached by the water, so that once a predetermined level is reached, an automatic deployment mechanism is triggered. This triggering is provided by the opening of one or more electrically operated valves, which supply a pressurised fluid, which may be compressed air, industrial oxygen, or any other gas, contained in one or more tanks at a specific pressure, and which, through the proper piping, carry it to the devices that deploy the aforementioned flotation elements.

The practical realisation of the system of the present invention allows for several possibilities, which may be done with devices enclosed in the vessel and connected to the internal activation system with the proper pipes. These devices being able to have access to the outside through a predetermined area when an emergency situation arises.

As will be shown later, the characteristics inherent in each type of embodiment differ, which means that in each specific case, one or the other may be chosen depending on specific needs.

According to the invention, a possible embodiment would consist of a mechanism enclosed inside a cylindrical body, capable of axial movement inside the cylindrical body when pushed by the pressurised fluid, and able to exit through a controlled area of the hull of the vessel and thereby allow the deployment of the flotation elements. Many of these mechanisms will be arranged inside the hull of the vessel, as many as are deemed necessary to maintain flotation of the vessel in case of need, separated from one another by a predetermined distance.

Another possible embodiment has been planned to use a device that is made up of two cylinders that can be screwed together, which enclose the unfolding body. These cylinders have a larger diameter at their bases, which are adjusted to the exterior and interior part of the hull of the vessel. The base of the exterior cylinder includes a pressurised sealed closure that is adapted to it, which when pushed by the pressurised fluid allows the flotation element to unfold. The number of devices planned for use is that deemed appropriate to maintain the flotation of the vessel.

Both embodiments resolve the problems mentioned earlier since they offer the possibility of housing the flotation elements inside the vessel, which will prevent the elements from suffering any deterioration and will guarantee the perfect functioning of the system.

Also, as was described earlier, the installation of the system does not require physical or aesthetic alteration of the hull of the vessel; the flotation elements do not suffer any deterioration, and there is no risk of explosion, as occurs with other systems. This way, this system is more commercially acceptable.

This way, a system like the one developed by this invention can perfectly fulfil the mission of keeping the vessel afloat in case of a breakdown, leak, accident, or similar occurrence, regardless of the trigger or flotation mechanism used, becoming a very versatile system with very broad possibilities for use.

BRIEF DESCRIPTION OF THE DRAWINGS

Other characteristics and advantages of the invention will be demonstrated in the detailed description of the preferred embodiment of the invention that follows, given as an example and not limiting, with reference to the drawings that accompany it, in which.

DESCRIPTION OF THE PREFERRED EMBODIMENT

Figure 1:
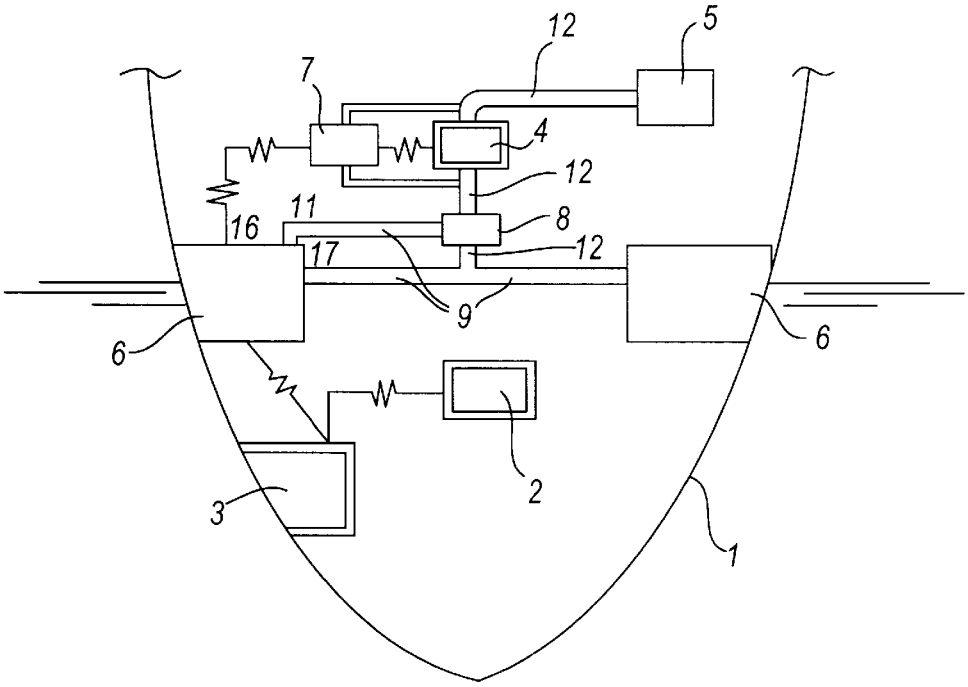
FIG. 1 shows a schematic view of the activation and trigger system of the invention.

The detailed description that follows of the preferred embodiment of this invention will make continuous reference to the different figures of the drawings, in which the same numerical references have been used to designate equal or similar parts. Looking in the first place at FIG. 1, it shows a schematic representation of a system conceived according the invention, enclosed in the interior space provided by the hull (1) of any type of vessel, and in which the different parts that make it up have been shown as blocks. The system is made up of two clearly differentiated parts, consisting of an electrical section and a pneumatic-mechanical section.

The electrical part is made up of a power source (2) that provides the electrical energy needed to feed the different components, and may be recharged with the proper means, a device (3) that communicates the level of the water in the hull, transmitting a signal to an electrically operated valve (4) in charge of allowing the passage of compressed air or another fluid used and held in tanks (5) on board. The device (3) is activated by virtue of the position that a flow meter or similar device (not shown) associated with it indicates progressively as water enters the interior of the vessel.

In regards to the pneumatic-mechanical part, it may be mentioned: the tank (5) that holds the air, oxygen, or other gas used to deploy the flotation elements, the electrically operated valve (4), one or more valves (7) of the bypass type, preferably manually activated, a regulation valve or regulation valves (8) designed to regulate the pressure in the circuits (10, 11) of air intake to the devices to deploy the flotation elements, retention valves (9) located at the intake pipe (10) to the deployment devices (6) of the flotation elements, and the devices themselves (6) for the beam expansion, varying in number. In regards to the regulation valve (8), it may be replaced, with equal effectiveness, by two pressure regulators.

According to the previous diagram, the functioning of the system can be easily understood and is as follows: when water enters the vessel (1) caused by some accidental or chance circumstance, the level detectors (3) detect this entry of water by means of the movement of the flow meter element associated with said detection device, so that when it reaches a particular position of the flow meter corresponding to a maximum established level, these devices (3) close the circuit which automatically lead to opening of the electrically operated valve (4) and allows the passage of the pressurised fluid held in the container (5).

If needed, the mechanism has one or more bypass valves (7), which makes it possible to manually open the passage of the pressurised fluid held in the container (5).

This way, the pressurised fluid circulates through the pipe (12), passing through the pressure regulator (8), the properly adjusted retention valves (9), until it finally reaches the beam expansion devices (6), where the trigger and unfolding mechanisms are activated for the flotation elements.

According to the invention, the deployment mechanism of the flotation elements may take different forms, without affecting the rest of the system. In effect, the pressurised fluid provided when the predetermined water level is reached in the interior of the vessel may be applied to any mechanism capable of performing this function of deploying the flotation elements on the outside of the vessel.

Figure 2:
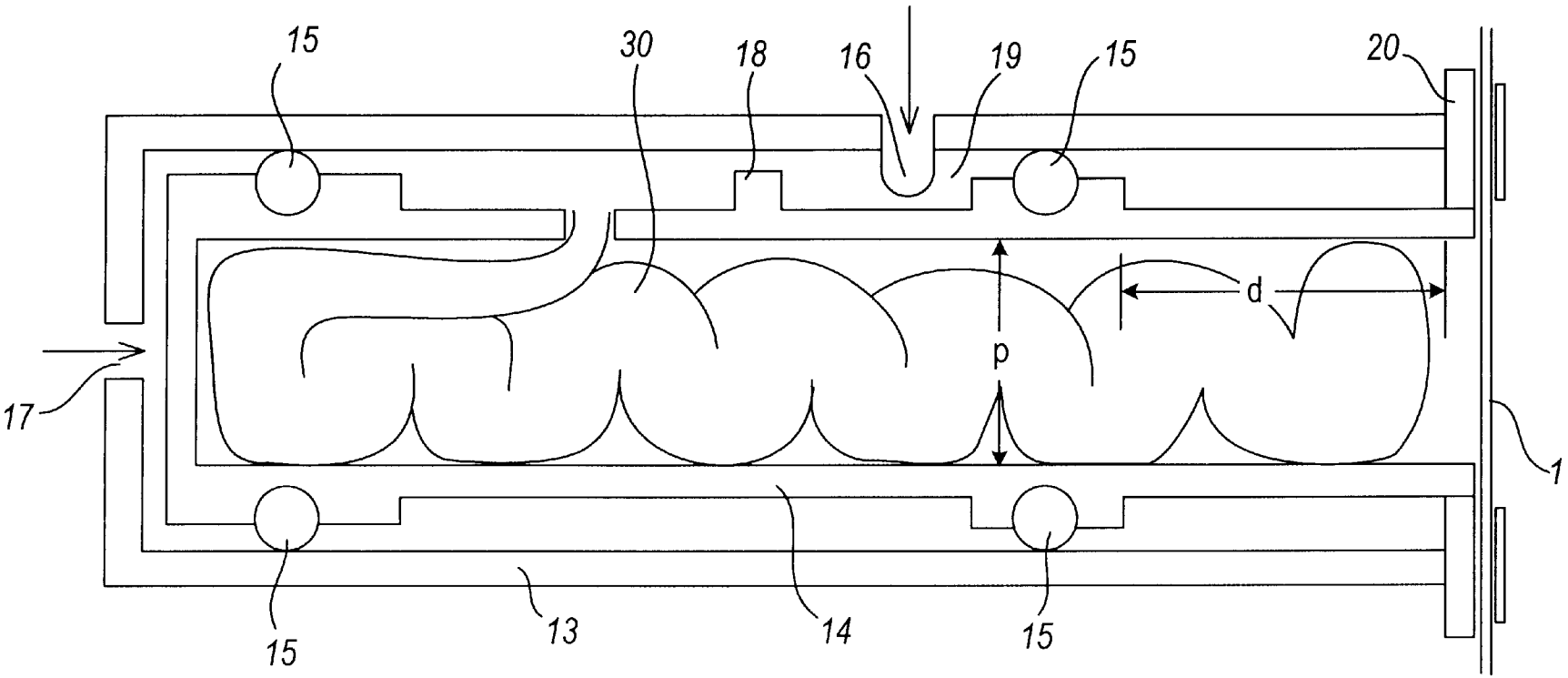
FIG. 2 also shows a schematic view of a possible embodiment of the mechanism for deploying the flotation elements.

FIG. 2 shows an example of the arrangement of a mechanism that could be used for the purposes of the invention, and which has been constituted as a cylindrical exterior body (13) in whose interior an element (14) is housed, with the same cylindrical shape, and inside which the deployment mechanism is housed, and which can be moved inside the first one when subjected to the push of the pressurised fluid introduced by openings such as those described (16, 17) in the FIG. in question. This mechanism is included inside each device (6) described with reference to FIG. 1. This way, when the means (3) causes the opening of the electrically operated valve (4), the pressurised fluid held in the container (5) circulates through the pipes continuously to the openings (16, 17).

The regulation valve or valves (8) are, at this point, in charge of regulating the intake pressure of the fluid at each one of the openings (16 and 17). The intake of the pressurised fluid through the opening (17) to the inside of the cylinder (13) causes the movement of the cylinder (14) inside the external cylinder (13) towards the outside of the hull. In other words, the valve or valves (8) select, on one hand, the fluid pressure at the opening (17), needed to cause the movement of the cylinder (14) along the distance (d) and on the other hand, the pressure of the fluid that enters through the opening (16) needed to cause the unfolding of the flotation elements, as will be commented later.

The trajectory of the run of the cylinder (14), or in other words, the distance (d), causes, on one hand, the breaking of the bladder (19) by means of the ridge (18) and on the other hand, the exit to the exterior of the cylinder through the area (p) preset in the hull of the vessel.

It must be understood that the preset area, as indicated (p) in FIG. 2, corresponds to a controlled area of the hull of the vessel, with a diameter approximately equal to the diameter of the cylinder (14), which is reinforced in its outside perimeter with a suitable material that prevents the uncontrolled breaking of the hull when the cylinder (14) is pushed to the outside by the pressurised fluid.

In turn, the movement of the cylinder (14), once it has covered the distance (d), activates the entrance of fluid through the opening (16) to the interior of the cylinder (14). This fluid, therefore, will act by allowing the inflatable flotation elements (30) located inside the cylinder (14), to be deployed at the flotation line level of the vessel, in order to keep it from sinking.

As shown in the FIG., the seal of both cylindrical bodies, to prevent the pressurised fluid that enters from either of the openings (16, 17) from escaping is guaranteed by the O-rings (15) located at pre-established points between these bodies (13, 14).

Figure 3:
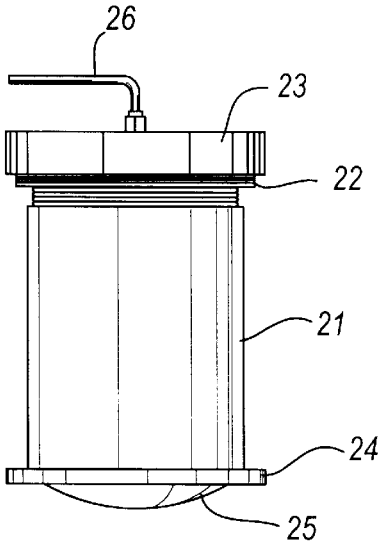
FIG. 3 shows an alternative embodiment for the aforementioned flotation elements.
Figure 4:
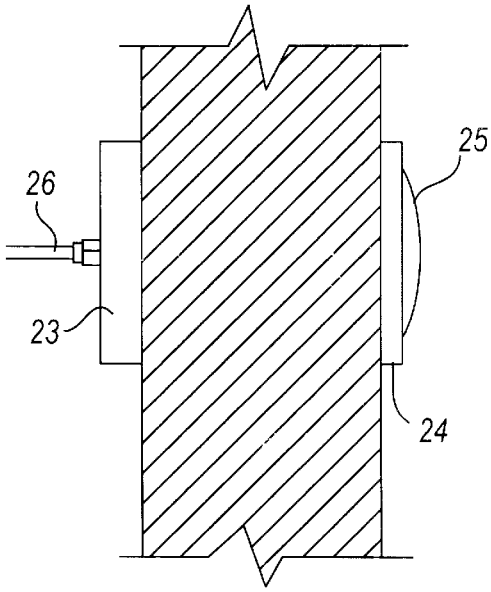
FIG. 4 is a representative detail of the means of the option in FIG. 3 adapted to the hull of the vessel.

FIGS. 3 and 4 show an alternative embodiment in which the unfolding mechanism of the flotation elements consists of two cylinders (21, 22), that can be screwed by means of providing, respectively, an internal and external area, whose bases have a diameter greater than the diameter of the cylinders themselves. This way, the larger diameter bases allow the adaptation and attachment to both the internal and external faces of the hull of the vessel, as shown in the aforementioned FIG. 4.

The base (24) of the external cylinder also includes a pressurised closure (25), acting as a cover, without protruding from the base; this cover will be ejected by the push caused by the pressure of the fluid introduced through the opening (26), leaving the inflatable element located on the inside of the internal cylinder (22) free; this inflatable element in turn expands by means of the entry of the pressurised fluid.

Unfolding elements designed for the flotation of the vessel according to this invention are considered to be all those elements capable of increasing the flotation surface of the vessel by filling themselves with the fluid supplied at pressure as indicated earlier. These elements may be made up of a base of materials of the polyurethane type, polyamide, or similar. In particular, it has been observed that stitched polyamide cloth covered on one side with polyurethane with a composition of 50% polyurethane and 50% polyamide is especially advantageous for the purposes of this invention.

It is not considered necessary to make the content of this description more extensive so that an expert in the subject may understand its scope and the advantages derived from the invention, as well as to develop and carry out the object of the same.

However, it must be understood that the invention has been described according to a preferred embodiment of the same, which means that it may be open to modifications without this supposing an alteration of the foundation of the invention, with such modifications possibly changing, in particular, the shape, size and/or manufacturing materials of the assembly or the parts.

What is claimed is:

1. A system for keeping a vessel afloat comprising:

an electrical section including a power supply, a detection device for detecting water entering the vessel, an automatic valve controlled by a signal produced from the detection device, the automatic valve being opened to allow passage of pressurized fluid through the system;

a mechanical section having a container for storage of the pressurized fluid, at least one bypass valve for manual activation of said system, a housing including first and second elements for storage of a flotation element, and pressure regulator for monitoring pressure within the system; and wherein pressurized fluid enters the housing and fills a gap between the first and second elements of the housing causing said first element of said housing to move in response to said fluid pressure to deploy said flotation element exteriorly of the hull of the vessel.

2. A system, as claimed in claim 1, wherein:

said first housing element is cylindrical, said second element is cylindrical and of a smaller diameter than said first housing element, said second element mounted within said first element allowing axial displacement of said first element in response to the fluid pressure, said first element breaking the hull of the vessel upon movement of said first element enabling the flotation element to deploy.

3. A system, as claimed in claim 1, further including:

o-rings placed between said first and second housing elements for enabling said first housing element to axially displace in a controlled manner.

4. A system, as claimed in claim 1, wherein:

said first housing element moves a first distance in response to the fluid pressure to allow the first housing element to break the hull, said first element moving a second distance to then allow the fluid pressure to inflate said flotation element, said flotation element being positioned near said hull so that said flotation element deploys exteriorly of the hull.

5. A system, as claimed in claim 1, wherein:

said detecting device is a flow meter measuring the level of water in the vessel.

6. A system for keeping a vessel afloat comprising:

an electrical section including a power supply, a detection device for detecting water entering the vessel, an automatic valve controlled by a signal produced from the detection device, the automatic valve being opened to allow passage of pressurized fluid through the system;

a mechanical section having a container for storage of the pressurized fluid, at least one bypass valve for manual activation of said system, a housing for storage of a flotation element and an external cover attached to said housing, and a pressure regulator for monitoring pressure within the system; and wherein pressurized fluid enters the housing and begins filling of the flotation element causing said flotation element to partially inflate, whereby the flotation element itself ejects said external cover of the said housing in response to said fluid pressure, and the flotation element then fully inflates for complete deployment of the flotation element exteriorly of the hull of the vessel.

7. A system, as claimed in claim 6, wherein:

said detecting device is a flow meter measuring the level of water in the vessel.

8. A method of keeping a vessel afloat, said method comprising the steps of:

providing a flotation system including a pressurized source of fluid, a valve enabling a flow of pressurized fluid from the pressurized fluid source, a housing communicating with said pressurized source of fluid, a flotation element housed within said housing, and a detecting device for detecting water entering the vessel;

producing a pressurized flow of fluid upon activation of the detecting device causing the valve to open;

axially displacing a first element of the housing with respect to a second element of the housing in response to the pressurized flow of fluid, the flow of fluid flowing in a gap between the first and second housing elements thereby causing said first housing element to axially move with respect to the second housing element;

moving the first housing element a first distance causing the first housing element to break the hull; and further moving the first housing element enabling the pressurized fluid to inflate the flotation element and to cause the flotation element to inflate exteriorly of the hull.

* * * * *